US005863229A

United States Patent [19]

Matte

[11] Patent Number: 5,863,229

[45] Date of Patent: Jan. 26, 1999

[54] VARIABLE VENTURI

[75] Inventor: Sylvain Matte, St-Denis De Brompton, Canada

[73] Assignee: Bombardier, Inc., Montreal, Canada

[21] Appl. No.: 661,381

[22] Filed: Jun. 11, 1996

[51] Int. Cl.[6] ..... B63H 11/10

[52] U.S. Cl. ..... 440/47; 60/221; 239/265.17

[58] Field of Search ..... 440/47, 38, 40; 239/265.17, 265.23; 60/221

[56] References Cited

U.S. PATENT DOCUMENTS

| | | | |
|---|---|---|---|
| 3,144,752 | 8/1964 | Kepler | 60/231 |
| 3,192,715 | 7/1965 | Engel et al. | 60/35.55 |
| 3,206,928 | 9/1965 | Moore | 440/40 |
| 3,273,333 | 9/1966 | Roulund | 60/221 |
| 3,288,373 | 11/1966 | Pike | 239/265.23 |
| 3,698,642 | 10/1972 | McCullough | 239/265.23 |
| 4,077,572 | 3/1978 | Fitzgerald | 239/265.17 |
| 4,176,616 | 12/1979 | Robins | 115/14 |
| 4,592,509 | 6/1986 | Moss | 239/424 |
| 4,643,685 | 2/1987 | Nishida | 440/42 |
| 4,826,084 | 5/1989 | Wallace | 239/290 |
| 4,977,845 | 12/1990 | Rundquist | 114/289 |
| 5,184,966 | 2/1993 | Kobayashi et al. | 440/38 |
| 5,244,425 | 9/1993 | Tasaki et al. | 440/47 |
| 5,256,090 | 10/1993 | Woolley | 440/40 |
| 5,294,055 | 3/1994 | Garrett et al. | 239/265.19 |
| 5,370,562 | 12/1994 | Nanami | 440/42 |
| 5,481,997 | 1/1996 | Arndt | 114/347 |

FOREIGN PATENT DOCUMENTS

| | | | |
|---|---|---|---|
| 0056508 | 7/1982 | European Pat. Off. . | |
| 1190537 | 10/1959 | France . | |
| 1288332 | 12/1962 | France . | |
| 2228661 | 12/1974 | France . | |
| 2288892 | 5/1976 | France . | |
| 128993 | 5/1990 | Japan | 440/47 |
| 6-72387 | 3/1994 | Japan . | |
| 0416727 | 9/1934 | United Kingdom . | |
| 1144436 | 3/1969 | United Kingdom . | |
| 1289094 | 9/1972 | United Kingdom . | |

OTHER PUBLICATIONS

Carl Camper, "The Squirt Gun," Watercraft World, Jul. 1996, pp. 143–149.

Charles Plueddeman, "Blazing Away," Boating, Feb. 1996, p. 90.

*Primary Examiner*—Sherman Basinger

*Attorney, Agent, or Firm*—Lieberman & Brandsdorfer, LLC

[57] ABSTRACT

The invention relates to a variable venturi for a watercraft vehicle or similarly powered vehicle which allows the operator of the vehicle to selectively choose to operate a watercraft vehicle for achieving maximum acceleration or, alternatively, maximum top end speed. The venturi is comprised of a collar surrounding the venturi adjacent to a distal end of the venturi. At such time as the collar is activated, exposing the water flow exiting the venturi to atmospheric pressure, the diameter of the water flow exiting the venturi is reduced by approximately 1.0 mm. to 1.5 mm. in radius. This slight change in the surface area of the water flow provides a lower mass flow of the exiting water with an increased velocity of the water and top speed of the vehicle. Alternatively, a larger diameter venturi provides a higher mass flow with a decreased velocity and maximum acceleration. In a preferred embodiment, the vehicle comprises a means for allowing the rotation of the engine or the pressure of the water flow to activate an actuator means for altering the surface area of the water exiting the venturi. The preferred embodiment is comparable to automatic shifting of a transmission for a conventional land vehicle. In an alternative embodiment, the collar may be manually controlled by an operator of the vehicle to modify the surface area of the water flow exiting the venturi, thereby allowing the vehicle to achieve maximum acceleration.

39 Claims, 7 Drawing Sheets

VARIABLE VENTURI

BACKGROUND OF THE INVENTION

1. Field of the Invention

This invention relates to a venturi for a watercraft vehicle, and more particularly to a novel venturi for varying the surface area of the water flow exiting the venturi, and a means for adjusting the surface area of the exiting water flow between alternative riding conditions.

2. Discussion of Related Art

Venturis and exit nozzle apparatuses for watercraft vehicles conventionally comprise components which are mounted to the venturi or nozzle for directing the flow of the exiting water. Typically, the flow direction apparatus comprise rotatable nozzles or deflectors within the nozzles for moving the exiting water in a particular direction. In general, the rotatable nozzles may be adjusted in vertical or horizontal directions. Accordingly, it has become common practice in the art for an exit nozzle or venturi of a jet pump for various watercraft vehicles to contain attachments thereon for directing the flow of the water exiting the jet pump and to thereby control the direction of travel for the vehicle.

Several fluid flow directing apparatuses for venturis and exit nozzles of watercraft vehicles, as well as other types of vehicles, have been patented. The nozzles disclosed in the Prior Art comprise means for controlling the direction of the fluids exiting the nozzles, thus controlling the direction of travel of the vehicle. However, none of the patents disclose a single means for affecting the thrust and acceleration of the vehicle by controlling the surface area of the water exiting the venturi. Furthermore, the Prior Art fails to disclose modifications to the velocity of the water exiting the venturi which affects the performance of the vehicle. The venturi functions to accelerate the water as it exits the stator vanes of the impeller of the jet propulsion unit. Based upon principles of classical physics, it is known that reducing the circumferential size of the venturi to accelerate the same amount of water as a standard size venturi will cause the acceleration of the water to increase. It has been determined that by changing the circumferential size of the exit orifice of the venturi, the thrust and velocity of the exiting water is affected.

For example, a wider diameter venturi exit orifice will decrease back pressure in the jet propulsion unit, and will allow a higher mass flow of water to be processed through the jet propulsion unit more rapidly while reducing the pump torque required. However, a larger diameter venturi exit orifice will cause a loss of top speed due to a reduced velocity of the water exiting the venturi. In comparison, if we select a venturi with a smaller exit orifice, the back pressure to the jet propulsion unit will increase. As a result, a lower mass flow of water is processed, but the velocity of the water exiting the venturi increases. This allows the vehicle to achieve higher speed, but does not provide the quantity of water necessary for good acceleration of the vehicle. Accordingly, different size exit orifices are a compromise for providing the best combination of acceleration and top speed for the vehicle.

Therefore, what is desirable is a novel venturi or nozzle for a jet propulsion unit for a watercraft vehicle having a means for adjusting the diameter of the water at a distal end of the venturi, wherein the velocity of the exiting water is variable among several different positions so that the thrust and acceleration allows the vehicle to achieve maximum top end speed in one configuration of the venturi and provides an improved acceleration with reduced power required from the jet propulsion unit in an alternative configuration.

SUMMARY OF THE INVENTION

It is therefore the general object of the present invention to provide a watercraft vehicle which may achieve maximum top end speed, as well as maximum acceleration by a relatively simple and cost effective means.

It is a further object of the invention to provide a collar positioned adjacent a distal end of the venturi for concentrically varying the velocity and surface area of the water flow exiting the venturi.

Furthermore, it is a further object of the invention to provide an actuator means for controlling exposure of a distal end of the venturi to atmospheric pressure, thereby allowing an operator of the vehicle to regulate the surface area and velocity of the water flow exiting the venturi and affecting performance of the vehicle between alternative riding conditions.

Another object of the invention is to provide an automated system that adjusts the velocity and surface area of the water flow exiting the venturi based upon perfonnance of the vehicle.

In accordance with the invention, these and other objectives are achieved by providing a variable venturi for a watercraft vehicle comprising a novel venturi having a collar apparatus concentrically surrounding a distal end of the venturi, and an actuator means attached to the collar for controlling the airflow and water flow entering the collar between alternative riding conditions. Accordingly, the invention controls the surface area and velocity of the exiting water flow by exposing a distal end of the venturi to atmospheric pressure in order to attain maximum top end speed or maximum acceleration through a relatively simple and cost effective means.

BRIEF DESCRIPTION OF THE DRAWINGS

These and other objects, features and advantages of the invention, as well as the invention itself, will become better understood by reference to the following detailed description when considered in connection with the accompanying drawings, wherein.

DETAILED DESCRIPTION OF THE PREFERRED EMBODIMENTS

Figure 1:
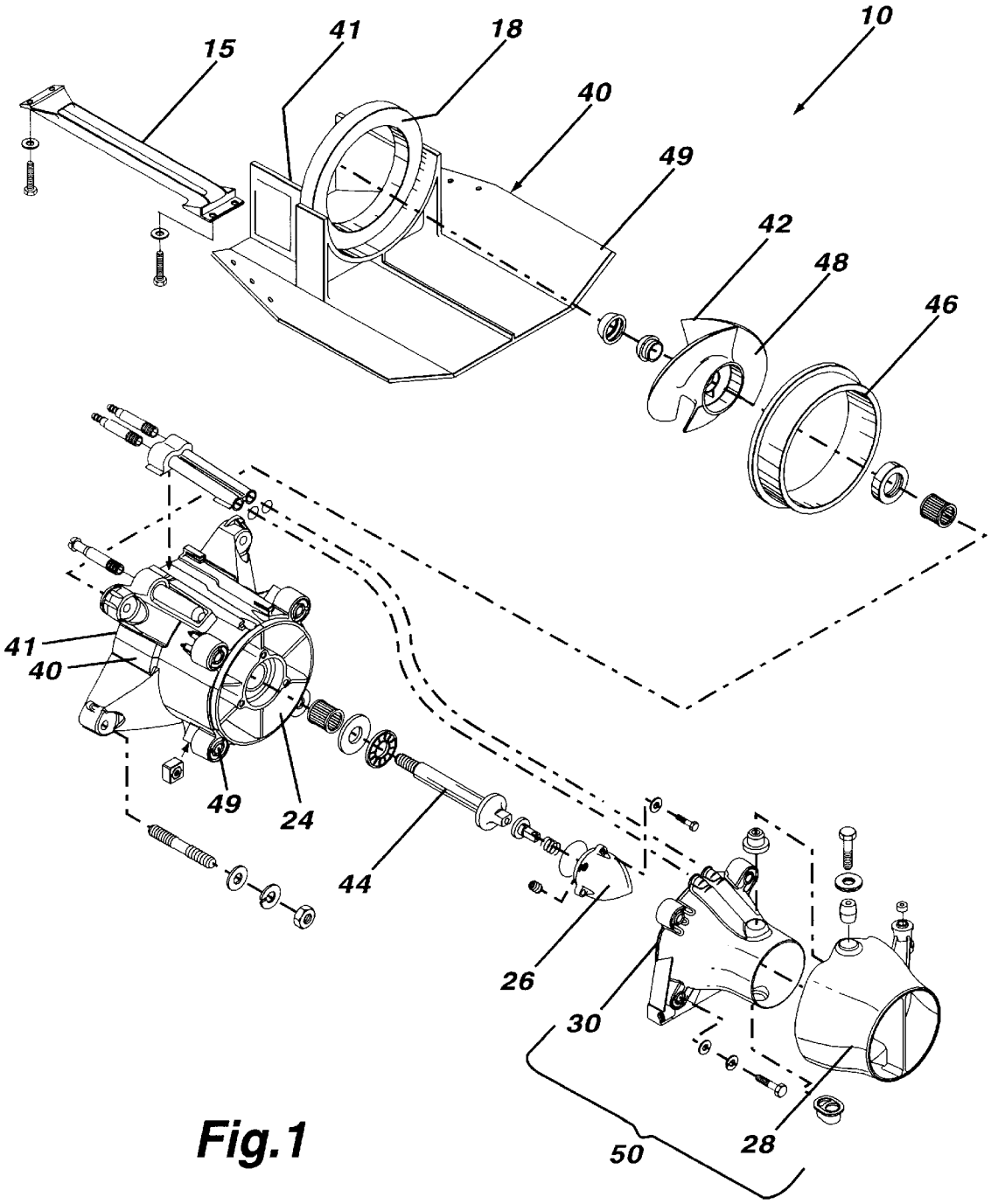
FIG. 1 is an exploded perspective view of a conventional jet pump unit and its mounting arrangement within a watercraft vehicle.

Although the disclosed invention may have broad applicability, it relates primarily to an apparatus for varying the surface area of the water exiting a venturi for a watercraft vehicle, and more specifically to a personal watercraft vehicle or similarly powered vehicle. The following description will indicate the parts of the novel apparatus with numbers assigned to each part to correspond to the attached drawings. Accordingly, it should be noted that like reference numerals are used throughout the attached drawings to designate the same or similar elements or components.

Referring now to the drawings, FIG. 1 illustrates a conventional jet propulsion unit 10 for a watercraft vehicle constructed and mounted in accordance with the embodiments of the invention. The jet propulsion unit 10 is comprised of an inner housing and an outer housing. The outer housing comprises a water intake grate 15 for allowing water into the propulsion unit. At low speed, the jet propulsion unit 10 creates a vacuum force at the intake through which the water travels. The intake grate is attached to the outer housing by means of screws at a distal end of the outer housing, and it allows for the free flow of water while protecting the jet propulsion unit 10 and its parts, such as an impeller 42, from pulling any harmful debris into the jet propulsion unit 10.

The outer housing further comprises a support 18 at a proximal end for receiving the impeller 42, an impeller housing assembly 40, and a venturi 30. The support 18 comprises a circularly shaped aperture extending through the center of the support 18, and is adapted for receiving the impeller 42. In addition, the support 18 comprises a means for receiving the impeller housing assembly 40 and is secured thereto by means of fasteners and O-rings. The support 18 and the impeller housing assembly 40 are both adapted for receiving the impeller 42 and its associated wear-ring 44. The impeller 42 comprises a plurality of blades 48 and a wear-ring 44 which surrounds the impeller, 42 as it spins. The impeller 42 spins inside very tight tolerances within the propulsion unit 10. The wear-ring 44 surrounds the impeller 42 such that if there is a problem the impeller 42 will damage an easy to replace item instead of the entire jet propulsion unit 10. The impeller 42 further comprises an impeller shaft 45 which is connected to the drive shaft of the engine through the impeller 42. The drive shaft of the engine causes the impeller 42 to rotate during use of the watercraft vehicle. At low speed, it is the rotation of the impeller 42 which creates a vacuum that pulls water into the inlet 15 of the jet propulsion unit 10. As the water approaches the rotating impeller 42, the blades 48 of the impeller 42 force the water toward a venturi 30 and a steering nozzle 28 at a stern end of the vehicle. It is the thrust created by the water mass accelerating in the venturi 30 which forces water through the jet propulsion unit 10 and moves the vehicle. The configuration of the jet propulsion unit 10 together with the impeller 42 allows the spinning impeller 42 to thrust water through the venturi 30.

The impeller 42 which is surrounded by a wear-ring 44 is further enclosed within an impeller housing 40 comprising a distal end 41 and a proximal end 49. The distal end 41 of the impeller housing 40 comprises a plurality of apertures for receiving attaching means and securing the impeller housing 40 to the support 18. The impeller housing 40 further comprises stator vanes 24 formed integrally within the impeller housing 40. The spinning action of the impeller 42 causes the water to leave the impeller housing 40 in a swirling torrent of inefficient force. The stator vanes 24 located aft of the impeller 42 function to align the water as it moves away from the impeller housing 40. Attached to a proximal end of the impeller housing 49 is a thrust cone 26 for directing the water to the nozzle assembly 50.

The steering nozzle 28 works to push the exiting water rearward in a controlled stream of propulsion. As shown in FIG. 1, the venturi 30 is distal of the steering nozzle 28 and functions to control the thrust and velocity of the water flow exiting the impeller housing 40. Accordingly, the water exiting the venturi 30 enters the steering nozzle 28 which redirects the water exiting the jet propulsion unit 10, allowing for controlled maneuvering of the watercraft vehicle.

The novel venturi 30 of the present invention comprises a collar 90 at a distal end of the venturi for controlling the surface area and velocity of the exiting water. As is well known in the art of watercraft vehicles, it is common practice to provide a steering nozzle 28 adjacent a venturi 30 of a jet propulsion unit 10 for the purpose of steering the watercraft vehicle. Such an arrangement is provided in this invention wherein the steering nozzle 28 is controlled by means of an assembly that is mounted adjacent a proximal end of the vehicle so that it may be operator controlled. Accordingly, the steering nozzle 28 and the venturi 30 of the present invention are mechanically interconnected in a known manner.

Figure 4:
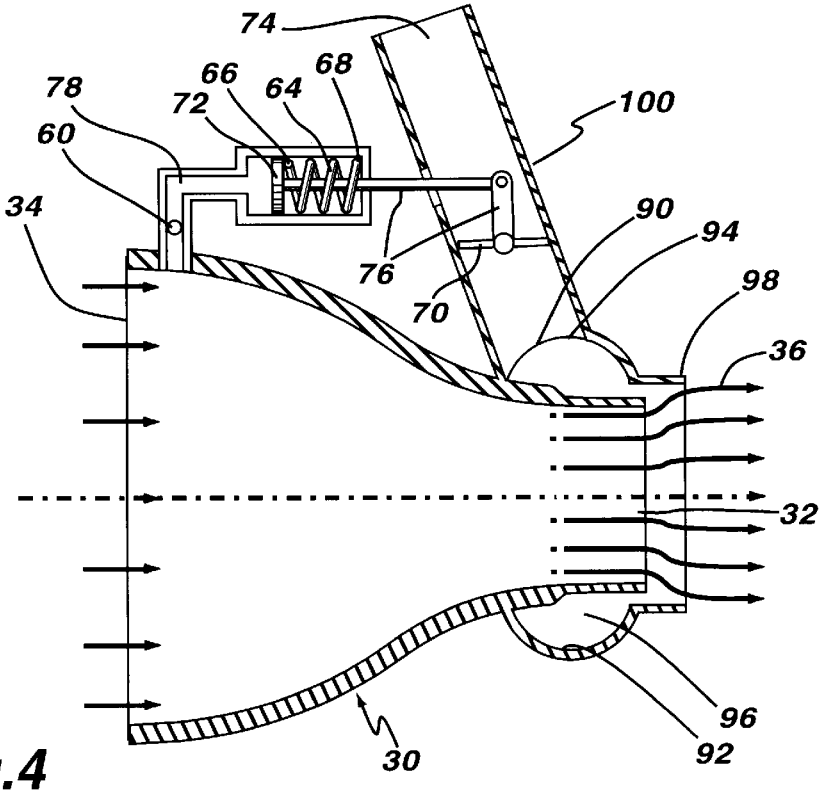
FIG. 4 is a side elevational view of the novel venturi with an exit water flow having a larger surface area of the present invention.
Figure 5:
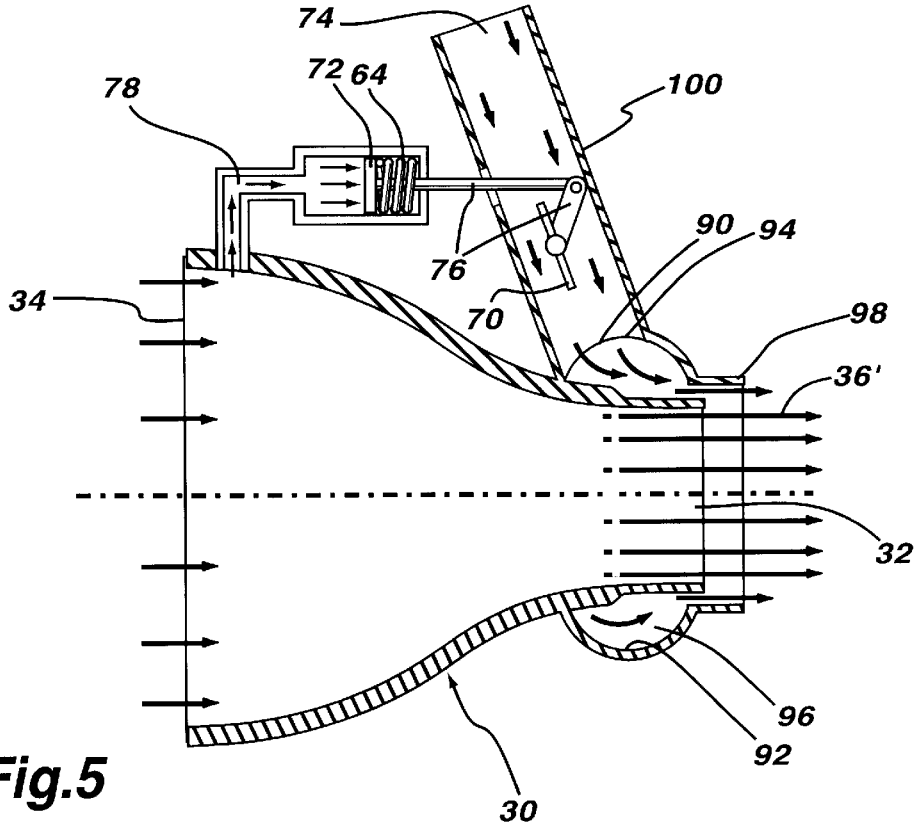
FIG. 5 is a side elevational view of the novel venturi with an exit water flow having a narrower surface area of the present invention.

In a preferred embodiment and best mode of the invention, the venturi 30 comprises a proximal end 34 and a distal end 32. Adjacent to the distal end 32 of the venturi 30 is a collar 90 surrounding the distal end 32 of the venturi 30. The collar 90 may be comprised of a metallic material, such as aluminum. However, instead of aluminum, the collar may be made from another material, such as a thermoplastic or polyvinyl chloride material, having suitable or similar quality. Preferably, the collar 90 is comprised of a solid material so that during use the collar can accommodate and withstand air pressure, as well as the turbulence of the water surrounding the venturi 30 and the steering nozzle 28. The collar 90 surrounds the distal end 32 of the venturi 30 and extends a short length beyond the venturi 30. There is a gap of approximately 2.0 mm between an inner surface 92 of the collar 90 and the an outer surface of the venturi 30, as seen in FIGS. 4 and 5, to accommodate exposure of the distal end 32 of the venturi 30 to atmospheric pressure. However, this gap may be reduced or enlarged by a few millimeters depending upon the configuration of the collar 90 and the air entering an interior portion 96 of the collar 90. The purpose of the collar 90 is to allow the surface area and velocity of the water flow exiting from a distal end 32 of the venturi 30 to be affected without physically altering the diameter of the venturi 30. In the preferred embodiment, the collar 90 is adjacent to the distal end 32 of the venturi 30 and does not rotate or move in any direction. See FIGS. 4 & 5. The collar 90 further comprises an aperture 74 having a control means therein.

In a first embodiment of the invention, the control means is comprised of a valve 70, a calibrated spring 64 and an actuator means 72. The valve 70 is connected to a mechanical linkage 76, which is further connected to a distal end of the calibrated spring 64. The valve 70 controls the opening and closing of the aperture 74, thereby controlling exposure of the water flow adjacent the distal end 32 of the venturi 30 to atmospheric pressure. When the valve 70 is in a horizontal position, the aperture 74 is closed and the water flow exiting the venturi 30 adapts to the size and shape of the distal end 98 of the collar 90. At such time as the valve 70 is in a vertical or angularly displaced position, the aperture 74 is open and the water flow exiting the venturi 30 adapts to a reduced surface area due to the affect of the atmospheric pressure. The calibrated spring 64 comprises a proximal end 66 and a distal end 68. The proximal end 66 of the spring 64 is located adjacent to an actuator means 72 which is connected to the proximal end 34 of the venturi 30 by means of a passageway 78. The actuator means 72 of the present invention may be in a pneumatic, hydraulic or an electronic structure. At such time as the pressure of the water adjacent to a proximal end of the venturi has attained or exceeded the constant of the calibrated spring 64, the actuator means 72 is activated and moved in a horizontal direction toward the distal end 32 of the venturi 30 and the calibrated spring 64 is forced to compress thereby causing the mechanical linkage 76 to rotate or slide the valve 70 in a vertical direction and allow air at atmospheric pressure to enter the aperture 74. The rotating or sliding movement of the valve 70 has the effect of displacing the atmospheric pressure from 36 to 36' and causing the surface area of the exiting water flow to adopt a reduced surface area consistent with the distal end 32 of the venturi 30. The difference in radius of the water flow exiting the distal end 32 of the venturi 30 is between 1.0 mm and 1.5 mm. The reduced surface area of the exiting water flow from the distal end 32 of the venturi 30 provides a lower mass flow of the exiting water with an increased velocity. At an optimal speed of the vehicle, the reduced surface area of the exiting water and the increased velocity of the water flow enables the vehicle to run at top end speed.

In a preferred embodiment, the actuator means 72 is controlled automatically by the rotation of the engine and the corresponding pressure of the water flow as it enters the proximal end 34 of the venturi 30. Since the jet propulsion unit 10 of the present invention is a closed environment, the rotation of the engine controls the jet propulsion unit 10 and the velocity and thrust of the water through the venturi 30. The actuator means 72 can be calibrated to automatically activate and be horizontally displaced at such time as the water flow entering the passageway 78 adjacent to the proximal end 34 of the venturi 30 reaches a predetermined pressure. For example, an optimal time to activate the actuator means 72 may be when the engine is running at approximately 5,500 revolutions per minute (RPM) and the pressure of the water flow at the proximal end 34 of the venturi 30 is approximately 2,000 mbar (30 pounds per square inch (psi)). However, since each jet propulsion unit 10 of each watercraft vehicle is calibrated to its own needs and specifications, the actuator means 72 may also have to be independently calibrated for each vehicle in order to achieve top end speed or maximum acceleration at an appropriate performance of the engine. If the actuator means 72 is activated when the engine is running at a low speed, i.e. the velocity of the water passing through the venturi is higher, exposure of the water flow adjacent to the distal end 32 of the venturi 30 to atmospheric pressure will not enable the vehicle to achieve top end speed. Accordingly, if the jet propulsion unit 10 is properly calibrated, the vehicle can have maximum acceleration at such time as the aperture 74 remains in a closed position and can achieve top end speed at such time as the aperture 74 is in an opened position.

The passageway 78 adjacent to the proximal end 34 of the venturi 30 further comprises a switch 60 for controlling the mechanical linkage 76 in an alternative embodiment. In this embodiment, the actuator means 72 and the calibrated spring 64 are replaced. Preferably, the switch 60 may be in the form of a sensor which is activated by the engine when it has reached a specific RPM. At such time as the engine reaches a preprogrammed RPM, which is preferably at or near 5,500 RPM, the sensor on the engine will activate the switch 60 for controlling the mechanical linkage 76 to rotate or slide the valve 70. Alternatively, the switch 60 may be in a mechanical or electrical form and comprise a means extending from the control panel of the vehicle to activate the switch 60. Manual control of the switch 60 and the actuator means 72 allows the operator of the vehicle to control top end speed at such time as the watercraft vehicle is operating in conditions where top end speed is an option. In a manual configuration, the switch 60 may take the form of a pneumatic or hydraulic actuator that extends from the switch 60 to the control panel of the vehicle and mechanically allows the operator to open or close the valve 70. The manual switch 60 may also be in the form of an electronic sensor, such as a solenoid, which may also be activated by the operator on the control panel of the vehicle. Activation of either a mechanical or electrical switch 60 would allow the water flow adjacent the distal end 32 to be exposed to a positive fluid pressure source, thereby decreasing the area and diameter of the jet water flow exiting the venturi.

In an alternative embodiment, the aperture 74 may comprise a tube 100 which extends from the aperture 74 to the hull of the watercraft vehicle. The tube functions to allow air to enter the aperture 74 at atmospheric pressure, and prevents any debris which may be adjacent to an external portion of the collar 90 and aperture 74 from entering the water flow. For example, if the operator of the vehicle desires to achieve top end speed when the engine is rotating over 5,500 RPM and performing so that the turbulence of the water adjacent to an external area of the venturi exposes the venturi 30 to atmospheric pressure, the operator may manually select the switch 60 to open or close the valve 70.

In a modification to the automatic control of the actuator means 72 of the preferred embodiment, the actuator means 72 may be calibrated to react upon pressure of the water flow entering the passageway 78. When the engine is rotating at 5,500 RPM, the pressure of the water flow exiting the impeller 42 and the stator vanes 24 is approximately 2,000 mbar (30 psi), which is the calibrated water pressure for the variable venturi to activate the smaller diameter of the venturi to achieve top end speed. Therefore, by calibrating the actuating means 72 to displace the calibrated spring 64 upon water entering the passageway 78 at 2,000 mbar (30 psi), the pressure of the water flow adjacent the distal end 32 of the venturi 30 will increase from 2,000 inbar (30 psi) to approximately 2,400 mbar (35 psi) due to the structural shape and nature of the venturi 30. Accordingly, the actuating means 72 may be calibrated to automatically activate the spring 64 upon a 2,000 mbar (30 psi) water flow entering the passageway 78.

As the water flow enters the proximal end 34 of the venturi 30, the pressure exerted on the water flow is positive and proceeds on a negative parabolic slope as it moves through the venturi 30 towards its distal end 32. When the water flow approaches the area of the collar where the aperture 74 of the collar 90 are located and are closed by means of the actuating means 72 and the valve 70, the pressure exerted on the water flow is negative and is held in a vacuum, as seen at 180 in FIG. 8. As the water flow proceeds to exit the venturi 30 at 36, the pressure exerted on the water flow begins a positive parabolic slope until it attains atmospheric pressure at a distal end 98 of the collar 90. Accordingly, in the alternative embodiment wherein the aperture 74 and the valve 70 of the collar 90 are in a closed position, the water flow exits the venturi 30 at 36 with a maximum surface area equivalent to the surface area of a distal end 98 of the collar 90 at atmospheric pressure as shown in FIGS. 4 and 5.

In a second configuration of the first embodiment, the valve 70 of the collar 90 is displaced so that the aperture 74 of the collar 90 is in an opened position, as shown in FIG. 5. The rotational or sliding movement of the valve 70 allows air at atmospheric pressure to enter the aperture 74 of the collar 90 and to affect the surface area, velocity and mass flow of the water flow exiting the distal end 32 of the venturi 30 at 36'. As the water flow enters the proximal end of the venturi, the water flow pressure is approximately 2,000 mbar (30 psi), as shown at 134 in FIG. 9. The water flow travels through the venturi in a negative parabolic curve as it approaches an area parallel to the aperture 74. As the water flow travels through the venturi and is exposed to air at atmospheric pressure entering the aperture 74, the atmospheric pressure will increase the pressure being exerted on the exiting water flow from the vacuum created at such time as the valve is in a closed position, so as to cause the surface area of the exiting water flow to adopt a reduced surface area consistent with the outlet portion 36' of the venturi 30, as shown in FIG. 5. Accordingly, by reducing the surface area of the exiting water flow, the velocity of the water flow increases providing a lower mass flow of the exiting water with maximum velocity, and allows the vehicle to attain top end speed.

A second embodiment of the invention is further disclosed in FIGS. 6, 7, 12 and 13. In the second embodiment, the collar 190 may comprise an inner ring 192 and an outer ring 196 adjacent to the distal end 32 of the venturi 30. The inner ring 192 extends a few millimeters beyond the outlet portion 36 of the venturi 30 and is comprised of a plurality of apertures 105 which extend from an interior surface of the inner ring 192 to an exterior surface of the inner ring 192. The apertures 105 may be in the form of round holes, slots or other comparable shapes. The apertures 105 are not limited by their shape so long as the shape and size of the apertures do not affect the structural integrity of the inner ring 192 while providing enough air flow to pass through the apertures 105 and affect the surface area of the exiting water flow by approximately 1.0 mm. to 1.5 mm. in radius. The inner ring 192 and the outer ring 196 may be comprised of a solid piece of metallic material such as aluminum. However, instead of aluminum the inner ring 192 and the outer ring 196 may be comprised of another material, such as thermoplastic or polyvinyl chloride, having a suitable or similar quality so as to accommodate adjustments made adjacent to the distal end 32 of the venturi 30 during use of the watercraft vehicle.

Figure 6:
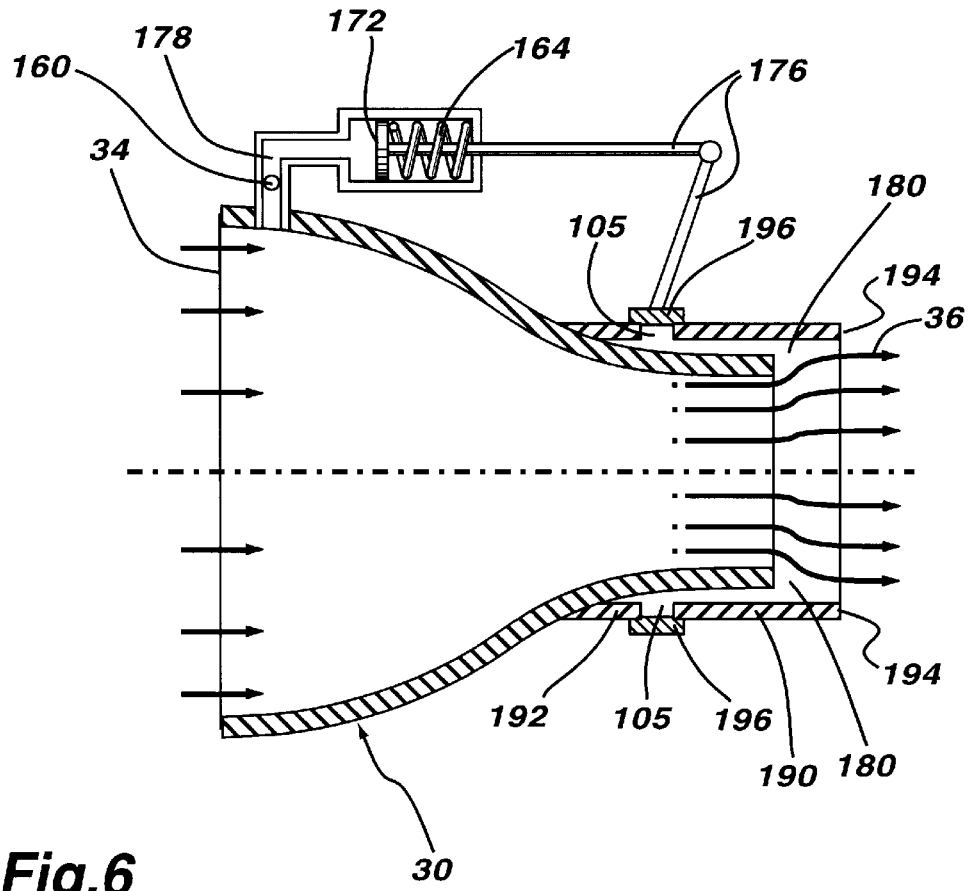
FIG. 6 is a side elevational view of a first alternative embodiment of the novel venturi with a larger surface area exit water flow.
Figure 8:
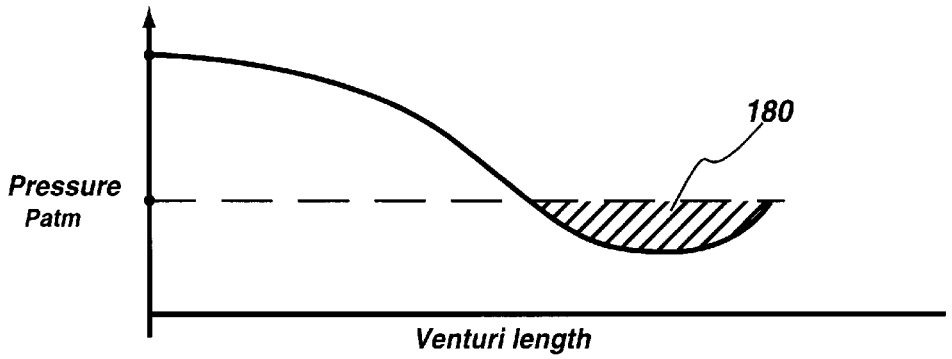
FIG. 8 is a graph illustrating the pressure of the water flow as it passes through the novel venturi with a larger surface area exit water flow.

At such time as the engine is rotating below 5,500 RPM, the outer ring 196 is located adjacent to the distal end 32 of the venturi 30 and covers the apertures 105 of the inner ring 192. In this position of the outer ring 196, the water flow entering the proximal end 34 of the venturi 30 is preferably at or below 2,000 mbar (30 psi), as shown in FIG. 8. As the water flow enters the proximal end 34 of the venturi 30, the pressure exerted on the water flow is positive and proceeds on a negative parabolic slope as it moves through the venturi 30 towards its distal end 32. When the water flow approaches the area of the collar where the apertures 105 of the inner ring 192 are located and are closed by means of the outer ring 196, the pressure exerted on the water flow is negative and is held in a vacuum, as seen at 180. As the water flow proceeds to exit the venturi 30 at 36, the pressure exerted on the water flow begins a positive parabolic slope until it attains atmospheric pressure at a distal end 194 of the inner ring 192. Accordingly, in the first alternative embodiment wherein the apertures 105 of the inner ring 192 are in a closed position, the water flow exits the venturi 30 with a maximum surface area equivalent to the surface area of a distal end of the inner ring 192 at atmospheric pressure as shown in FIGS. 6 and 7.

Figure 7:
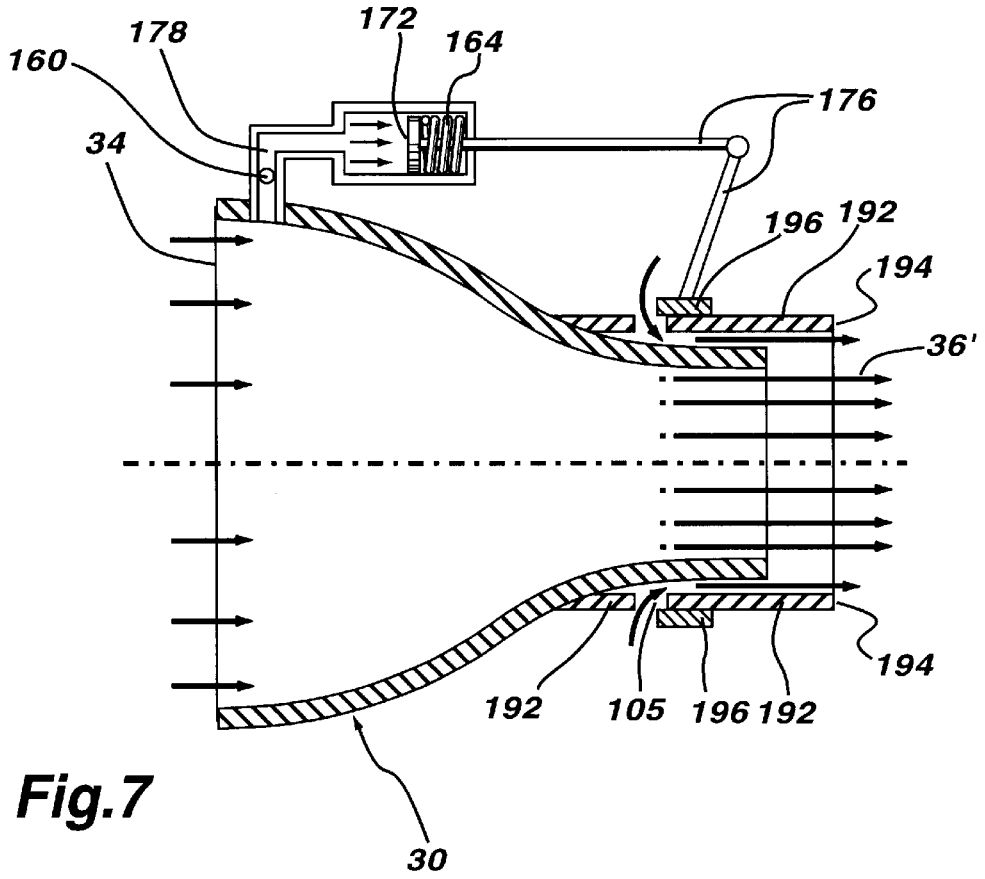
FIG. 7 is a side elevational view of a first alternative embodiment of the novel venturi exhibiting a smaller surface area exit water flow.

In a second configuration of the second embodiment, the outer ring 196 is laterally displaced so that the apertures 105 of the inner ring are in an opened position, as shown in FIG. 7. The lateral movement of the outer ring 196 allows air at atmospheric pressure to enter the apertures 105 of the inner ring 192 and to affect the surface area, velocity and mass flow of the water flow exiting the distal end 32 of the venturi 30 at 36'.

Movement of the outer ring 196 in the second embodiment of the invention is controlled by a mechanical linkage 176 and an actuator means 172 similar to the one described in the preferred embodiment of the invention. The outer ring 196 is mechanically attached to a mechanical linkage 176 for controlling the actual lateral movement of the outer ring 196. The mechanical linkage 176 is further connected to a calibrated spring 164 and an actuator means 172. The actuator means 172 is preferably automatically controlled by the rotation of the engine or the pressure of the water flow entering the proximal end 34 of the venturi 30. When the actuator means 172 is controlled by rotation of the engine, the actuator means 172 will activate at such time as rotation of the engine reaches approximately 5,500 RPM, although this setting could vary depending upon calibration of the engine and the actuator means 172. Alternatively, the actuator means 172 may be calibrated to be horizontally displaced at such time as the pressure of the water flow adjacent to the passageway 178 has attained or exceeded the constant of the calibrated spring adjacent to. In general, the engine may be calibrated to rotate at 5,500 RPM when the water flow is at 2,000 mbar (30 psi). The displacement of the actuator means 172 causes the calibrated spring 164 to move the mechanical linkage 176 laterally moving the outer ring 196 to open the apertures 105. By opening the apertures 105, the pressure of the water flow entering the proximal end 34 of the venturi 30 increases from 2,000 mbar (30 psi) to approximately 2,400 mbar (35 psi) due to the shape of the venturi 30 and the decreased surface area of the water flow passing through the venturi 30. In a similar but reverse method, the actuator means 172 may be calibrated to activate the calibrated spring 164 and mechanical linkage 176 displacing the outer ring 196 to close the apertures 105 of the inner ring 192 at such time as the rotation of the engine decreases to approximately 5,000 RPM or the pressure of the water flow entering the passageway is below 2,000 mbar (30 psi).

As in the preferred embodiment of the invention, it is preferable that the actuator means 172 be calibrated to automatically respond to the rotation of the engine or the pressure of the water flow entering the proximal end 34 of the venturi 30 and the passageway 178. It has been determined through extensive testing that it is preferable for the actuator means 172 to be activated at approximately 5,500

RPM corresponding to a water flow pressure at a proximal end 34 of the venturi 30 of approximately 2,000 mbar (30 psi). However, the actuator means 172 of the invention may be configured to activate at a higher or lower engine rotation value or corresponding water flow pressure depending upon calibration of the vehicle engine and the jet propulsion unit 10. Alternatively, the vehicle may comprise a sensor (not shown) on the engine which activates the actuator means 172 and calibrated spring 164 at a preprogrammed engine performance.

The second embodiment may further comprise a switch 160 which functions similar to the switch 60 of the preferred embodiment. The switch 160 may be mechanical or electrical and comprise a means extending from a control panel of the vehicle to activate the switch 160. Manual control of the switch 160 allows the operator of the vehicle to control top end speed at such time as the watercraft vehicle is operating in conditions where top end speed is an option. Only when the vehicle has reached a specific velocity where the turbulence of the water surrounding an external surface of the venturi 30 exposes the venturi 30 to air may the switch 160 be activated. At such time the switch 160 is manually controlled. The switch 160 in its mechanical form may be pneumatic or hydraulically controlled, and in its electrical form may be a solenoid valve. Activation of switch 160 causes the outer ring 196 to be laterally displaced thereby exposing the apertures 105 of the inner ring 192 and allows air to enter the apertures 105 exposing the water flow adjacent the distal end 32 of the venturi 30 to atmospheric pressure.

In an alternative embodiment, the outer ring 196 of the first alternative embodiment may comprise a plurality of apertures therein (not shown). During operation of the vehicle at low velocities, the solid parts of the outer ring 196 are aligned with the apertures 105 of the inner ring 192 so that the water flow passing through the venturi 30 is not exposed to atmospheric pressure. However, in this alternative embodiment, movement of the outer ring 196 is accomplished through rotation of the outer ring 196, causing the apertures of the outer ring 196 to align with the apertures 105 of the inner ring 192. By aligning the apertures of both the inner ring 192 and the outer ring 196, air at atmospheric pressure enters the apertures 105 of the inner ring 192 and affects the pressure of the water, which furthers modifies the velocity and surface area of the water flow exiting the distal end 32 of the venturi 30.

Figure 10:
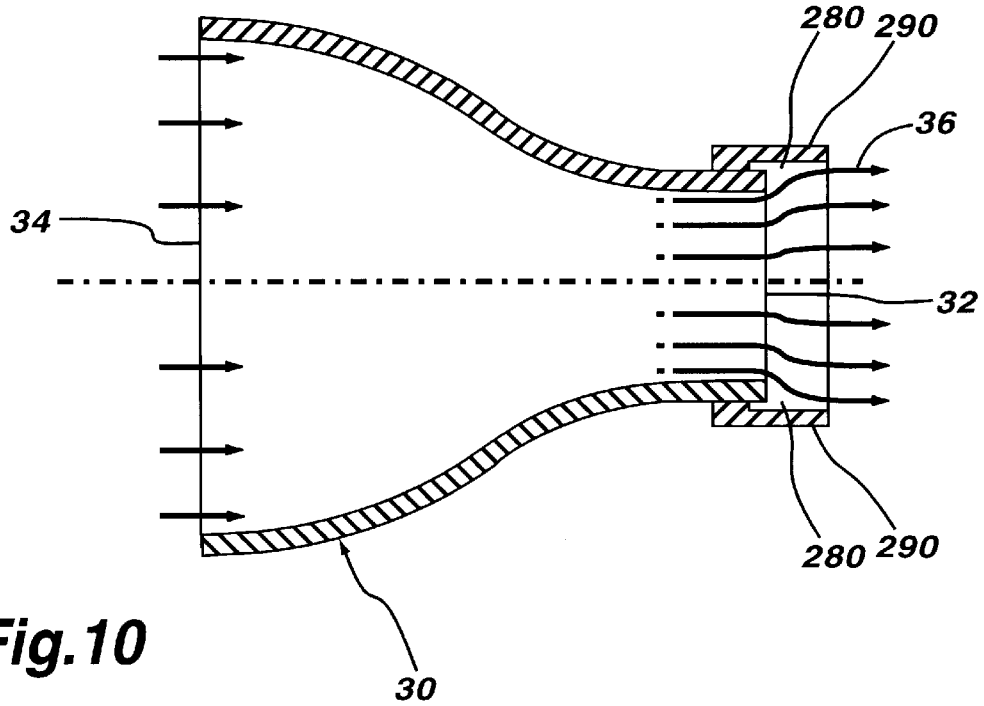
FIG. 10 is a side elevational view of a second alternative embodiment of the novel venturi exhibiting a larger surface area exit water flow.

In a third embodiment of the invention, the collar means 90 comprises a plurality of displacing rings 290 located adjacent to the distal end 32 of the venturi 30. The displacing rings 290 enable the water flow exiting the venturi 30 to adapt different surface areas and change its velocity depending upon the diameter of the displacing ring 290 extending furthest from the distal end of the venturi. FIG. 10 illustrates the second alternative embodiment with only one displacing ring 290 surrounding the distal end 32 of the venturi 30 and extending therefrom. The displacing ring 290 of this embodiment is L-shaped and extends beyond the distal end 32 of the venturi 30 at such time as the vehicle is stationary or operating at low velocities. As shown in FIG. 10, as the water flow exits the distal end 32 of the venturi 30 at low velocities, the surface area of the water flow adapts to the size and shape of the displacing ring 290. There is a gap 280 formed between the exiting water flow and the displacing ring 290 which naturally forms due to the shape and extension of the displacing ring 290. This gap 280 causes the water flow passing through this area to be held in a vacuum, i.e. in negative pressure, similar to the water flow passing through the outer ring 196 of the first alternative embodiment formed adjacent to the apertures 105 of the inner ring 192, as shown in FIG. 6. As the water flow proceeds to exit the venturi 30, the pressure of the water flow begins a positive parabolic slope as it exits the outlet portion 36 of the venturi 30 and reaches atmospheric pressure. Accordingly, the exiting water flow surface area adapts to the size and shape of the displacing ring 290 as it exits the outlet portion 36 of the venturi 30 which is larger than the size and shape of the distal end 32 of the venturi 30.

Figure 9:
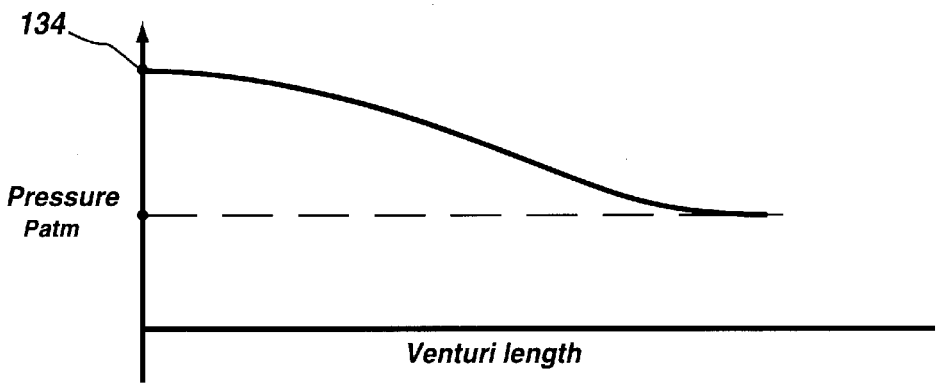
FIG. 9 is a graph illustrating the pressure of the water flow as it passes through the novel venturi with a smaller surface area exit water flow.
Figure 11:
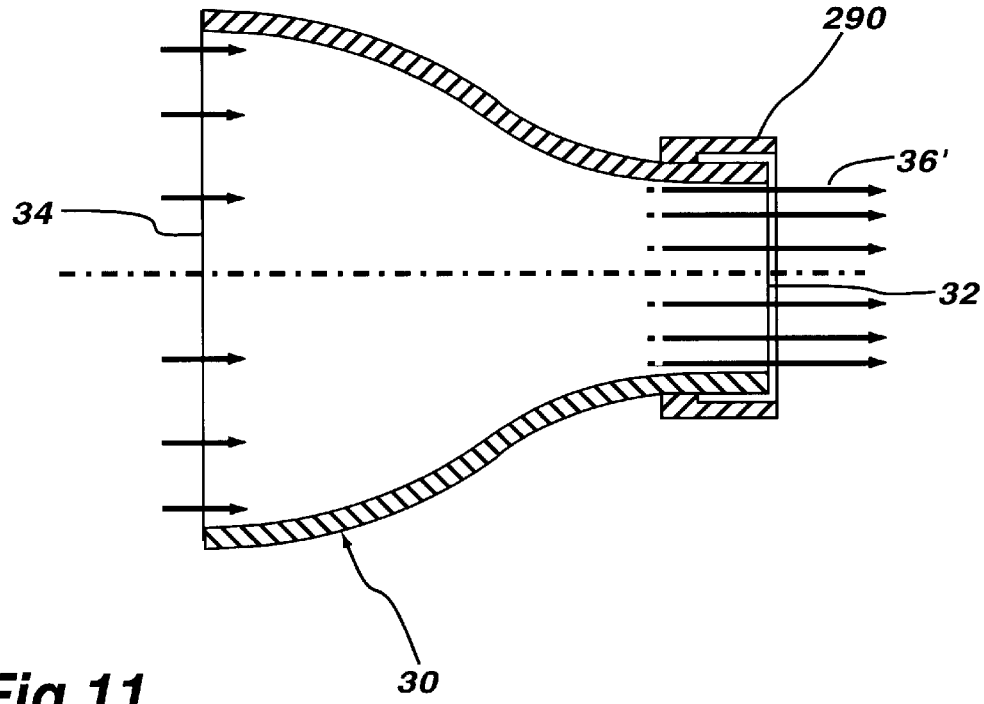
FIG. 11 is a side elevational view of a second alternative embodiment of the novel venturi with a smaller surface area exit water flow.
Figure 12:
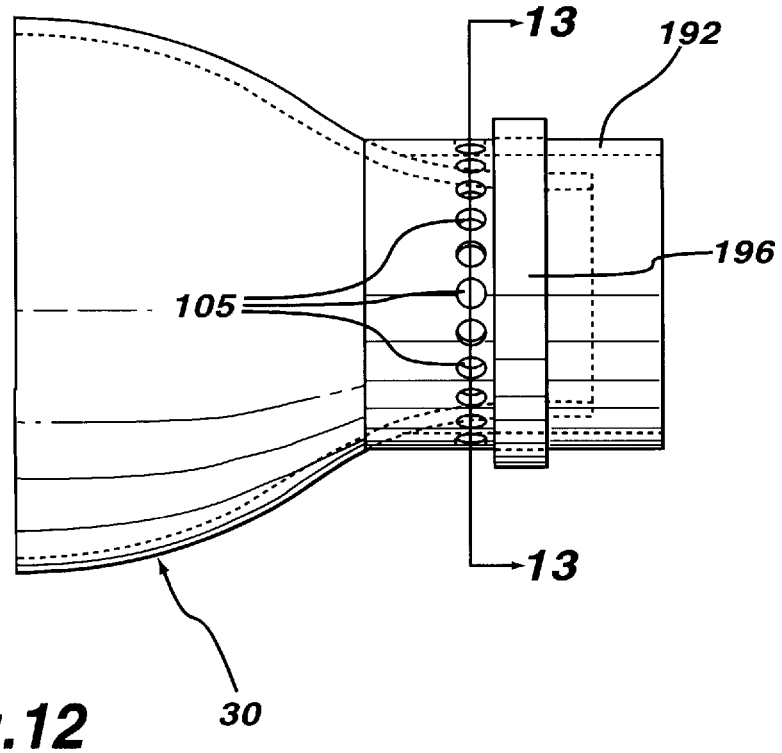
FIG. 12 is a side elevational view of the collar with apertures spaced about the circumference and a closing mechanism of the present invention.
Figure 13:
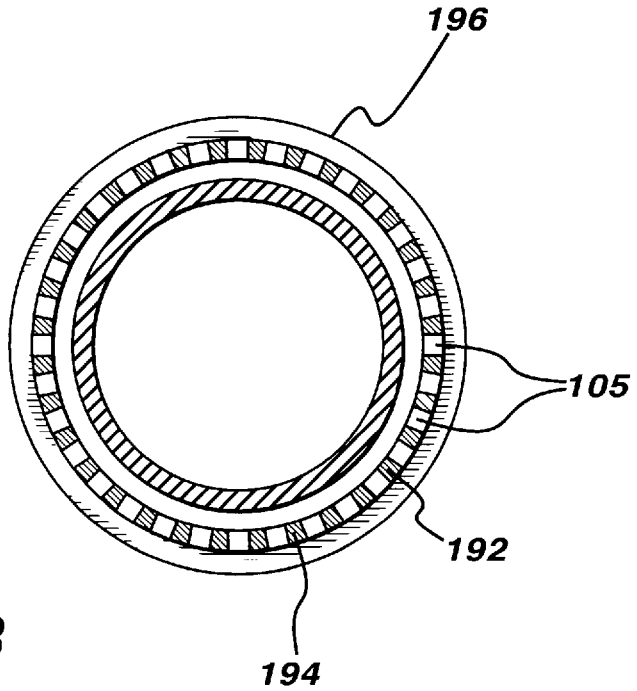
FIG. 13 is a cross sectional view of the collar with the apertures spaced about the circumference and the closing mechanism.

At such time as the venturi 30 is surrounded by turbulent water, the displacing ring 290 may be laterally displaced toward the proximal end 34 of the venturi 30. The displacing ring 290 only extends slightly beyond the distal end 32 of the venturi 30, and the gap 280 which held the water flow in a vacuum is not present in this configuration. By moving the displacing ring 290 toward the proximal end 34 of the venturi 30, the vacuum gap 280 is no longer present and the exiting water flow is exposed to air at atmospheric pressure. FIGS. 9 and 11 illustrate the pressure excited on the water flow as it passes through the venturi 30 without any vacuum present in the water flow. Accordingly, as the displacing ring 290 is moved toward the proximal end 34 of the venturi 30, the water flow passing through the distal end 32 of the venturi 30 being subject to atmospheric pressure, adapts to the smaller size and shape of the outlet portion 36' of the venturi 30.

Although this second embodiment of the invention has been described in detail with only one displacing ring 290 presented adjacent to the distal end of the venturi 30, it is within the scope of the embodiment to have several displacing rings 290 present wherein each of the displacing rings are adjacent to each other and comprise different diameters. By laterally displacing each of the displacing rings 290 separately, the size and shape of the exiting water flow is affected by adapting to the varying sizes of the rings. The means for automatically and manually displacing the rings 290 is equivalent to the mechanism of the preferred embodiment and the first alternative embodiment of the present invention incorporating the mechanical linkage together with a calibrating spring and an actuating means.

At such time as the engine is rotating at approximately 5,500 RPM, the velocity of the watercraft vehicle should be approximately 40 km/hr and automatic activation of the actuator means 72 or 172, or manuel displacement of the value 70 or ring 196, should be optimal. However, if the engine is rotating below 5,500 RPM, top end speed will not provide any benefits to the performance and acceleration of the vehicle. A consistent enlarged surface area and velocity for the water flow exiting the distal end 32 of the venturi 30 enables the vehicle to accelerate smoothly. Accordingly, if the operator of the vehicle desires to achieve top end speed and is accelerating the vehicle so that the turbulence of the water adjacent to the venturi 30 exposes the venturi 30 and steering nozzle 28 to atmospheric pressure, the operator may selectively choose to rotate the value 70 or displace the ring 196 or 290, and expose the water flow adjacent to the distal end 32 of the venturi 30 to atmospheric pressure. Movement of the actuator means 72 or 172, or displacement of the valve 70 or outer ring 196 or 290 either subjects the water flow adjacent to the distal end 32 of the venturi 30 to atmospheric pressure or allows the water flow to remain in its closed environment. Exposing the water flow adjacent to the distal end 32 of the venturi 30 to atmospheric pressure during optimal performance of the vehicle reduces the surface area of the water flow exiting the venturi 30 and provides lower mass flow of the exiting water with increased velocity, thereby enabling the vehicle to achieve top end speed. Alternatively, if the vehicle is running at low acceleration or if the water flow adjacent to the distal end of the venturi is not exposed to atmospheric pressure, the water flow exits the venturi 30 with a greater surface area and allows the vehicle to achieve maximum acceleration.

Regardless of the configurations of the above disclosed alternative embodiments of a means for exposing the exiting water flow to atmospheric pressure, the variable venturi actuator may be in the engine bay of the vehicle and will initiate at such time as the watercraft vehicle attains a specific speed or engine rotation wherein the venturi 30 is not submerged below the water level. Although the intake grate 15 of the jet propulsion unit 10 must always be submerged below the water level during use of the vehicle, the venturi 30 and steering nozzle 28 are not submerged when the vehicle attains a sufficient acceleration and velocity, i.e. greater than 10 km/hr, and the turbulence of the water subjects the venturi 30 and steering nozzle 28 to atmospheric pressure. At such time as the venturi 30 is exposed to atmospheric pressure, the mechanical linkage 76 or 176, the switch 60 or 160 and associated actuator means 72 or 172 may be utilized to affect the acceleration and movement of the vehicle.

Figure 2:
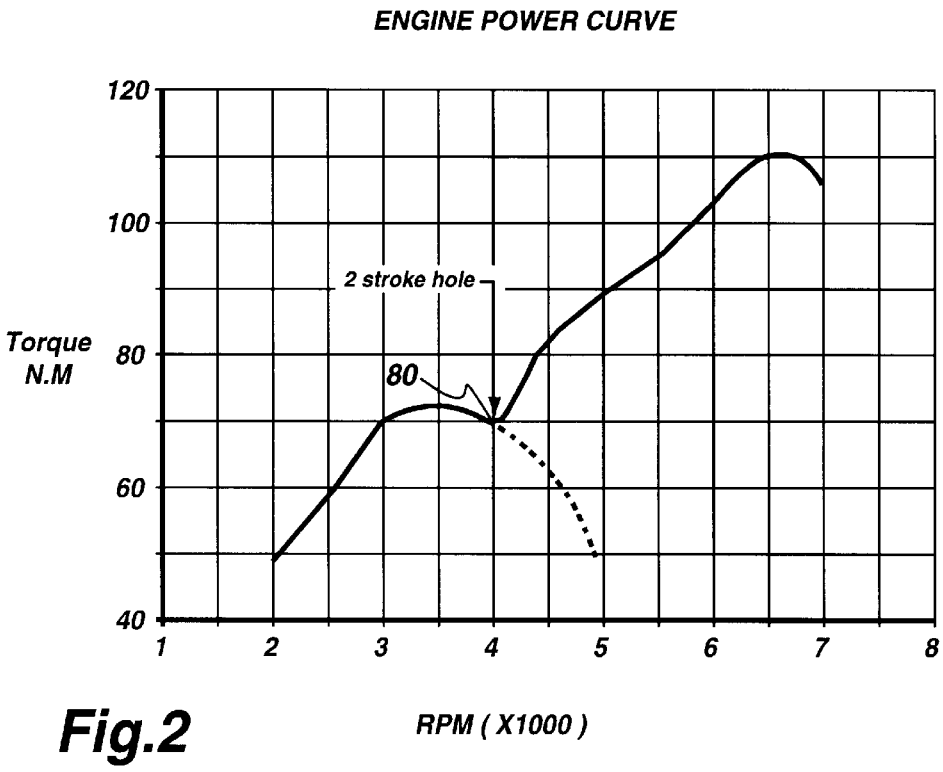
FIG. 2 is a graph of a power curve for a two-stroke engine showing the power delivered by the engine.
Figure 3:
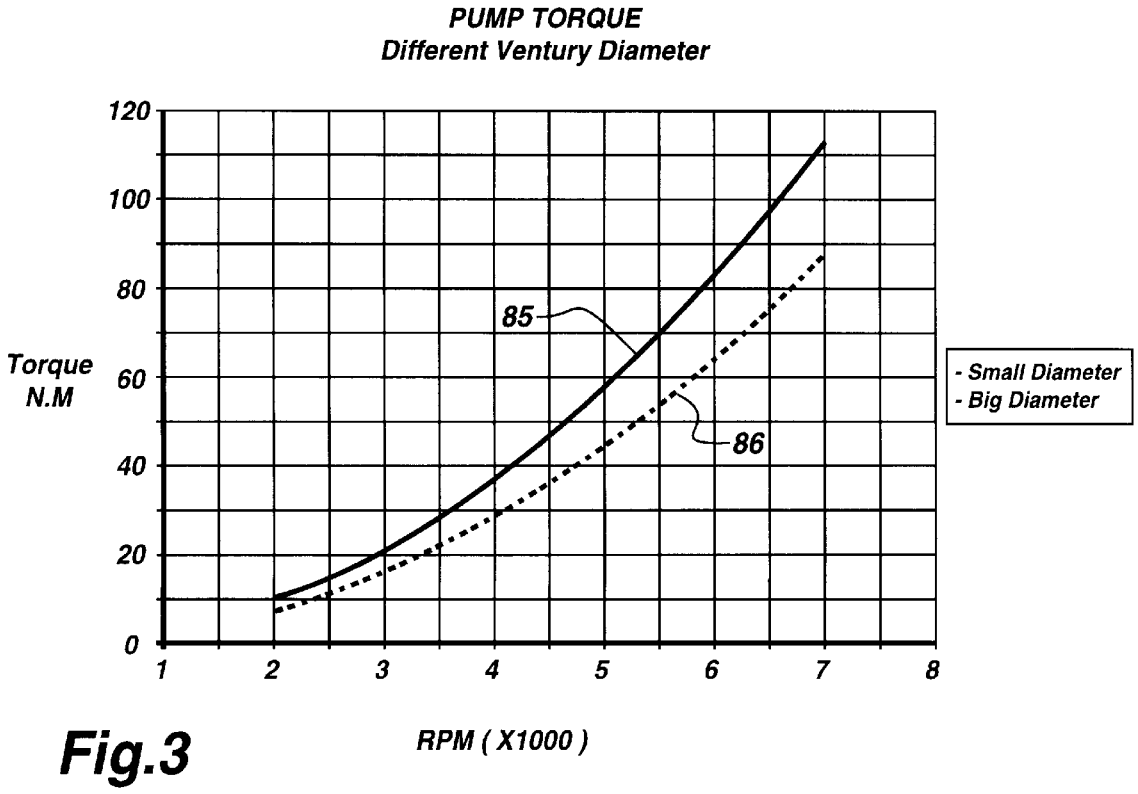
FIG. 3 is a graph of the torque required by the pump with two different venturi diameters.

In an alternative embodiment of the invention, an operator of the watercraft vehicle may control the surface area and velocity of the water flow exiting the venturi 30 of the jet propulsion unit 10 with minimum costs and maintenance to the vehicle. FIGS. 2 and 3 are graphs illustrating the benefits of the variable venturi apparatus in a conventional watercraft vehicle having a two stroke engine. FIG. 2 is illustrative of a two stroke engine and the torque delivered by the engine for a given RPM. At 80 the graph shows what is called a "two stroke hole", which is typically created by a two stroke engine with a tuned pipe configuration. The two stroke hole 80 is typically representative of a zone where the vehicle engine operation is unstable. With the tuned pipe configuration, as soon as the engine RPM increases the torque delivered by the engine dramatically increases as well.

The addition of a variable venturi 30 to the jet propulsion unit 10 allows the inventor to overcome the two stroke hole 80 as illustrated in FIG. 2. In an initial rest position, the variable venturi 30 is not exposed to any external air pressure and the surface area of the water flow exiting the venturi 30 is relatively large providing maximum acceleration of the vehicle. The large diameter venturi 30 allows the engine to run at a higher RPM in order to reach a desired speed of approximately 40 km/hour at greater than 4,000 RPM, thereby passing the two stroke hole 80 present when the engine conventionally operates at approximately 4,000 RPM. FIG. 3 illustrates the torque of the pump with a large diameter venturi and a small diameter venturi. Curve 86 illustrates a wider diameter venturi showing the performance of the jet propulsion unit 10 when the water flow adjacent to the distal end of the venturi 30 is not exposed to external air pressure. Curve 88 illustrates a small diameter venturi 30 showing the performance of the jet propulsion unit 10 when the water flow adjacent to the distal end 32 of the venturi 30 is exposed to atmospheric pressure. As is shown in FIG. 3, the difference in the torque of the pump with both configurations of the venturi diameter begins to dramatically increase at approximately 5,500 RPM. Accordingly, as such time as the engine reaches a rotation at or near 5,500 RPM, it is at an optimal speed for the operator of the vehicle to engage the variable venturi so as to obtain top end speed, as shown in FIG. 2. The purpose for the improved modification to the venturi is to maximize acceleration of the vehicle by reducing the torque of the jet propulsion unit for a specific engine rotation and to then load the jet propulsion unit to obtain maximum top end speed at a second specific engine rotation. However, the scope of the invention should not be limited to achieving top end speed at a water pressure of 2,000 mbar (30 psi) or at an engine rotation of 5,500 RPM. These factors are illustrative of an example of a watercraft vehicle. These factors may be modified for different sizes and styles of personal watercraft vehicles or similarly powered vehicles.

The ability to manually modifying the diameter of the venturi is similar to manual shifting a transmission of a land vehicle. By exposing the water flow adjacent to the distal end of the venturi to atmospheric pressure, and thereby decreasing the surface area of the water flow exiting the venturi, the vehicle performance is improved dramatically. The decrease in the surface area of the exiting water flow and the lower mass flow of the exiting water enables the vehicle to run at top end speed with an increase of approximately 5.0 to 6.0 m.p.h. Furthermore, in the preferred embodiment wherein the engine controls the actuator means 72 or 172, valve 70, or outer ring 196 or 290 and the exposure of the water flow to atmospheric pressure, the configuration of the venturi 30 is similar to an automatic transmission of a land vehicle wherein the engine controls the shifting of the transmission. In such an embodiment, the actuator means 72 or 172 may be configured to automatically displace when the engine reaches a rotation of 5,500 RPM. Accordingly, the rotation of the engine at 5,500 RPM in this example produces a minimum thrust of approximately 300 pounds and a maximum thrust of approximately 600 pounds.

In a standard jet propulsion unit 10, the surface area of the water flow exiting the outlet portion 36 of the venturi 30 is constant and adapts to the diameter of the distal end 32 of the venturi 30. Prior to the novel variable venturi of the present invention, the size and configuration of the venturi was always a compromise. However, with the variable venturi of the present invention there is less of a compromise and an ability to actually shift the surface area of the exiting water flow among several different positions so as to control the acceleration, top speed and overall performance of the vehicle.

The above description is of a collar means 90, 190, or 290 generally mounted to a venturi for a watercraft vehicle or a similarly powered vehicle, such as a personal watercraft vehicle. In a further embodiment of the invention, the variable venturi apparatus may be in the form of a kit separate from the vehicle as a whole. The kit may be assembled and attached to a conventional watercraft vehicle or similarly powered vehicle and used to modify an already existing venturi.

The above description is of a generally novel venturi for adjusting the surface area and velocity of the water flow exiting the venturi for a watercraft vehicle. Although the present invention has been described in connection with preferred embodiments thereof, it will be appreciated by those skilled in the art that additions, deletions, modifications, and substitutions not specifically described may be made without departing from the spirit and scope of the invention as defined in the appended claims and the scope should not be limited to the dimensions indicated hereinabove.

What is claimed:

1. A venturi for a watercraft vehicle, comprising:

a collar adjacent to a distal end of said venturi, said collar comprising an inner ring and an outer ring, said outer ring comprising an actuator means attached to an outer surface of said venturi for controlling displacement of the outer ring and the water flow exiting said venturi, wherein said actuator means being activated by the pressure of the water flow adjacent to a proximal end of the venturi and exposing the water flow exiting said venturi to air at atmospheric pressure thereby decreasing the area of the exiting water flow.

2. The venturi of claim 1, wherein said inner ring having a circumference and plurality of apertures spaced about the circumference of the inner ring.

3. The venturi of claim 2, wherein said outer ring being attached to a mechanical linkage for controlling lateral displacement of said outer ring.

4. The venturi of claim 3, further comprising a calibrated spring attached to said mechanical linkage at a distal end of said spring for controlling lateral displacement of said outer ring.

5. The venturi of claim 4, wherein said calibrated spring having an actuator means attached to a proximal end of said spring for controlling movement of said spring.

6. The venturi of claim 5, wherein a proximal end of said actuator means being connected to a passageway adjacent to the proximal end of the venturi.

7. The venturi of claim 6, wherein said actuator means being activated by pressure of the water flow entering said passageway adjacent to the proximal end of the venturi.

8. The venturi of claim 7, wherein said water flow pressure being 30 psi.

9. The venturi of claim 6, wherein said actuator being activated by a sensor.

10. The venturi of claim 9, wherein said sensor being automatically controlled by performance of the engine.

11. The venturi of claim 10, wherein said sensor being activated at 5,500 RPM.

12. The venturi of claim 9, wherein said sensor being a mechanical sensor controlled by an operator of the vehicle.

13. The venturi of claim 12, wherein said sensor being pneumatic.

14. The venturi of claim 9, wherein said sensor being an electrical sensor controlled by an operator of the vehicle.

15. The venturi of claim 14, wherein said sensor being a solenoid.

16. The venturi of claim 3, wherein said surface area of the water flow exiting the distal end of the venturi being decreased by laterally displacing said outer ring to expose the apertures of the inner ring to atmospheric pressure.

17. The venturi of claim 16, wherein said surface area of the water flow exiting the distal end of the venturi being increased by laterally displacing said outer ring to close the apertures of the inner ring.

18. A venturi for a watercraft vehicle, comprising:

a collar adjacent to a distal end of the venturi;

a means for shifting the performance of the vehicle by controlling exposure of the water flow exiting said venturi to atmospheric pressure by laterally displacing said collar and exposing the water flow exiting the distal end of the venturi to a positive pressure source;

wherein said positive pressure source decreasing the area of the exiting water flow from the venturi.

19. The venturi of claim 18, wherein the shifting means being controlled by an actuator means attached to said collar.

20. The venturi of claim 19, wherein said shifting means being automatically controlled by pressure of the water flow entering a proximal end of the venturi.

21. The venturi of claim 20, wherein said water flow pressure being 30 psi.

22. The venturi of claim 19, wherein said shifting means being automatically controlled by rotation of the engine.

23. The venturi of claim 22, wherein rotation of said engine being 5,500 RPM.

24. The venturi of claim 19, wherein said shifting means being manually controlled by an operator of the vehicle.

25. A venturi for a watercraft vehicle, comprising:

a collar adjacent to a distal end of the venturi, a means for changing the surface area and velocity of the water flow exiting the venturi, said collar comprising an aperture for allowing air to enter an interior portion of said collar, a valve for controlling opening and closing of said aperture, and a calibrated spring being attached to a mechanical linkage at a distal end of the spring for controlling movement of said valve.

26. The venturi of claim 25, wherein the calibrated spring having an actuator means attached to a proximal end of the spring for controlling movement of the spring.

27. The venturi of claim 26, wherein a proximal end of said actuator means being connected to a passageway adjacent to a proximal end of said venturi.

28. The venturi of claim 27, wherein said actuator means being activated by pressure of the water flow entering said passageway adjacent to a proximal end of the venturi.

29. The venturi of claim 28, wherein said water flow pressure being 30 pounds per square inch (psi).

30. The venturi of claim 27, wherein said actuator means being automatically controlled by performance of the engine.

31. The venturi of claim 30, wherein said actuator means being activated at 5,500 RPM.

32. The venturi of claim 27, wherein said actuator means being activated by a sensor.

33. The venturi of claim 32, wherein said sensor being a mechanical sensor controlled by an operator of the vehicle.

34. The venturi of claim 33, wherein said sensor being pneumatic.

35. The venturi of claim 32, wherein said sensor being an electrical sensor controlled by an operator of the vehicle.

36. The venturi of claim 35, wherein said sensor being a solenoid.

37. The venturi of claim 27, wherein the surface area of the water flow exiting the distal end of the venturi being decreased by moving said valve into a vertical position and exposing the aperture of the collar to atmospheric pressure.

38. The venturi of claim 37, wherein the decrease of the surface area of the exiting water flow allowing the vehicle speed to reach top end speed.

39. The venturi of claim 38, wherein the vehicle speed is increased by six miles per hour.

* * * * *

UNITED STATES PATENT AND TRADEMARK OFFICE

CERTIFICATE OF CORRECTION

PATENT NO. : 5,863,229
DATED : January 26, 1999
INVENTOR(S) : Sylvain Matte

It is certified that error appears in the above-indentified patent and that said Letters Patent is hereby corrected as shown below:

Column 8, line 44, "adjacent to" should be deleted

Column 10, line 20, "excited" should read --exerted--

Column 10, line 45, "manuel" should read --manual--

Signed and Sealed this

Twenty-sixth Day of October, 1999

*Attest:*

Q. TODD DICKINSON

*Attesting Officer*

*Acting Commissioner of Patents and Trademarks*